US005835069A

United States Patent [19]

Skoog

[11] Patent Number: 5,835,069

[45] Date of Patent: Nov. 10, 1998

[54] GPS ANTENNAS AND RECEIVERS CONFIGURED AS HANDLES FOR A SURVEYOR'S OPTICAL TOTAL STATION

[75] Inventor: Paul N. Skoog, Mountain View, Calif.

[73] Assignee: Trimble Navigation Limited, Sunnyvale, Calif.

[21] Appl. No.: 717,415

[22] Filed: Sep. 20, 1996

[51] Int. Cl.[6] ..... H01Q 3/00

[52] U.S. Cl. ..... 343/765; 343/882; 343/892

[58] Field of Search ..... 343/745, 754, 343/765, 757, 880, 882, 892, 700 MS; H01Q 1/12, 3/00, 3/02

[56] References Cited

U.S. PATENT DOCUMENTS

| | | | |
|---|---|---|---|
| 3,421,095 | 1/1969 | Hardway | 343/757 |
| 4,652,890 | 3/1987 | Crean | 343/882 |
| 5,223,845 | 6/1993 | Eguchi | 343/757 |
| 5,475,395 | 12/1995 | Nakamura et al. | 343/882 |
| 5,526,010 | 6/1996 | Plunk | 343/880 |
| 5,594,460 | 1/1997 | Eguchi | 343/757 |
| 5,646,638 | 7/1997 | Winegard et al. | 343/882 |

*Primary Examiner*—Don Wong
*Assistant Examiner*—Tho Phan
*Attorney, Agent, or Firm*—Thomas E. Schatzel; Law Offices of Thomas E. Schatzel, A Prof. Corp.

[57] ABSTRACT

A GPS antenna comprises an antenna body that can rotate between horizontal and vertical positions between the handle horns on the top of an optical total station. A GPS receiver embodiment comprises an integrated body and antenna that can similarly be rotated between horizontal and vertical positions between the handle horns on the top of an optical total station to avoid interference with the total station optics.

6 Claims, 4 Drawing Sheets

GPS ANTENNAS AND RECEIVERS CONFIGURED AS HANDLES FOR A SURVEYOR'S OPTICAL TOTAL STATION

BACKGROUND OF THE INVENTION

1. Field of the Invention

The invention relates generally to survey instruments and more specifically to global positioning system devices for attachment to theodolites or total stations for optical, combined optical and electronic surveys.

2. Description of the Prior Art

Relatively crude instruments were once used for land surveying. Surveyors used simple optical theodolites or transits to determine the horizontal azimuth angles and the vertical elevation angles between survey points. Chains and tape measures were used to measure the distance between a theodolite and a point to be established. Telescopic devices, e.g., horizontal levels, and graduated rods were also used to determine the actual elevation of a point or location from a reference.

Surveying has advanced considerably. Laser light and infrared beams are now used in combination with retro-reflective devices, such as corner cube prisms, in the determination of precise distances. The beams are reflected back by the retro-reflective devices as parallel collinear beams of energy back to the receiver/transmitter. Phase angle measurements and timing circuits allow the exact distance between the transmitter and reflector to be precisely determined and displayed. Such electronic instruments have greatly improved the accuracy that is possible by a surveyor in the taking of measurements and the setting of points. Typically, these electronic distance measuring devices are used to provide range measurements to remotely located reflecting devices or prisms that may be as far away as two or three thousand feet.

Electronic measuring devices have been combined with conventional transit/theodolite instruments and levels, and vertical collimators, into a combination instrument called a total station. Well known manufacturers of these instruments include such companies as Sokkia, Geotronics, Zeiss, Topcon and Leica. The total station ordinarily includes an optical telescope in the theodolite which has a standard magnification of thirty power. Total stations can visually measure vertical, as well as horizontal, angles and can perform the calculations required by a surveyor.

In geodetic surveying, or geodesy, distances and angles can be measured by electro-optical methods to determine the positions of measuring points in a relevant coordinate system. Conventional electro-optical distance measuring instruments transmit a modulated light beam of infrared light, which is reflected from a prism of cubical configuration placed on the target point for the purpose of taking measurements. The light reflected by the prism is received and phase-detected, thereby enabling the distance to be determined with great accuracy. The vertical angle and horizontal direction to the target point can also be determined electrically or electro-optically. The measuring instrument is allowed to take repeated measurements and to continuously determine the position of a moving target, where the measuring instrument is directed onto the target manually.

Several limitations existed in use of conventional total stations. First, it was difficult to quickly establish the angular orientation and absolute location of a local survey or datum. Many surveys are not related to a uniform datum, but exist only on a localized datum. In order to accurately orient a survey to a global reference, such as astronomical north, a star observation for azimuth is often used that requires long and complicated field procedures. Second, if a survey is to be connected to a national or state geodetic datum, the survey sometimes must be extended long distances, such as tens of kilometers, depending upon the proximity of the survey to geodetic control marks. Third, the electronic total station relies upon line-of-sight contact between the survey instrument and the rodman or pole carrier, which can be a problem in rough terrain.

One electronic total station instrument for surveying, and measuring elevation differences, is disclosed by Wells, et al., in U.S. Pat. No. 4,717,251. A rotatable wedge is positioned along a surveying transit line-of-sight, and is arranged to be parallel to a local horizontal plane. As the wedge is rotated, the line-of-sight is increasingly diverted until the line-of-sight passes through a target. The angular displacement is then determined by electro-optical encoder means, and the elevation difference is determined from the distance to the target and the angular displacement. This device can be used to align a line-of-sight from one survey transit with another survey transit or to a retro-reflector.

Nakamura, et. al., describe in U.S. Pat. No. 5,475,395, issued Dec. 12, 1995, a reflecting mirror and a microstrip antenna for receiving signals from GPS satellites. The reflecting mirror is supported by a base that can swing on a horizontal axis and rotate on a vertical axis. The antenna is supported above the reflecting mirror on a bearing with a vertical axis that is coaxial with the vertical axis of the reflecting mirror. The antenna is then supplemented with a reflecting mirror. The reflecting mirror is rotated on the vertical axis to point in the direction of an electronic distance meter or total station that can accurately determine the distance and angle.

A surveying instrument that uses the global positioning system (GPS) measurements for determining the location of a terrestrial site that is not necessarily within a line-of-sight of the surveyor is disclosed in U.S. Pat. No. 5,077,557, issued to Ingensand. The instrument uses a GPS signal antenna, receiver and processor combined with a conventional electro-optical or ultrasonic range finder and a local magnetic field vector sensor at the surveyor's location. The range finder is used to determine the distance to a selected mark that is provided with a signal reflector to return a signal issued by the range finder to the range finder. The magnetic field vector sensor is apparently used to help determine the surveyor's location and to determine the angle of inclination from the surveyor's location to the selected mark.

Ingensand states that the object of his invention is to permit the surveying of points with the aid of a satellite system that are not situated in the direct range of sight of the satellites. An instrument solution to this problem includes a noncontact measuring range finder that can be tilted and combined with a satellite receiver in a "geometrically unambiguously defined relative position". The operation of the instrument involves a remote measuring point which is aimed at with a sighting device and a vertical setting of the instrument is simultaneously monitored with the aid of a vertical sensor. An optical range finder is disposed, in the example, directly below the GPS satellite receiver that permits measurements of distances to remote points fitted with reflectors.

However, the GPS satellite receiver, or at least its antenna which needs a clear view of the sky above, can optically interfere with the optical range finder at some azimuths because they are both mounted on the same plumb rod.

Ingensand, et al., describe in U.S. Pat. No. 5,233,357, issued Aug. 3, 1993, a surveying system that includes an electro-optic total station and a portable satellite position-measuring receiver system. Ingensand, et al., explains that because the quasi-optic propagation characteristics of the waveband chosen for the GPS transmission system, good reception of the satellite signals requires that the receiving antenna be visible to the satellites. Such reception can be interrupted by obstacles such as plant cover, buildings, etc. Signal loss can cause measurement errors or prevent operation entirely. The assumption is the GPS signals at the total station may be inadequate. The approach taken is to provide a wireless data transmission system for coupling a satellite position measuring system with better signal reception location to a total station to transmit position data to the total station. But such a loose collection of equipment is not very easy to use and is time-consuming to setup and breakdown.

What is needed are GPS antennas or whole GPS receivers physically fashioned as handles in an optical total station. Such GPS antennas and receivers must be positioned in such ways on a total station that their bodies and support do not interfere with the optical tasks.

SUMMARY OF THE PRESENT INVENTION

It is therefore an object of the present invention to provide navigation satellite receivers and antennas strategically positioned on total station surveying instruments.

It is another object of the present invention to provide GPS receivers and antennas that can do double duty as handles when the total station is being transported.

Briefly, a GPS antenna embodiment of the present invention comprises an antenna body that can rotate between horizontal and vertical positions between the handle horns on the top of an optical total station. A GPS receiver embodiment of the present invention comprises an integrated body and antenna that can similarly be rotated between horizontal and vertical positions between the handle horns on the top of an optical total station to avoid interference with the total station optics.

An advantage of the present invention is that navigation satellite receivers and antennas are provided that have a clear radio access of the whole hemisphere above an optical total station.

Another advantage of the present invention is hat a navigation satellite receivers and antennas are provided that can be folded up to serve as a carrying handle for an optical total station.

These and other objects and advantages of the resent invention will no doubt become obvious to those of ordinary skill in the art after having read the following detailed description of the preferred embodiment that is illustrated in the drawing figures.

IN THE DRAWINGS

DETAILED DESCRIPTION OF THE PREFERRED EMBODIMENT

Figure 1A:
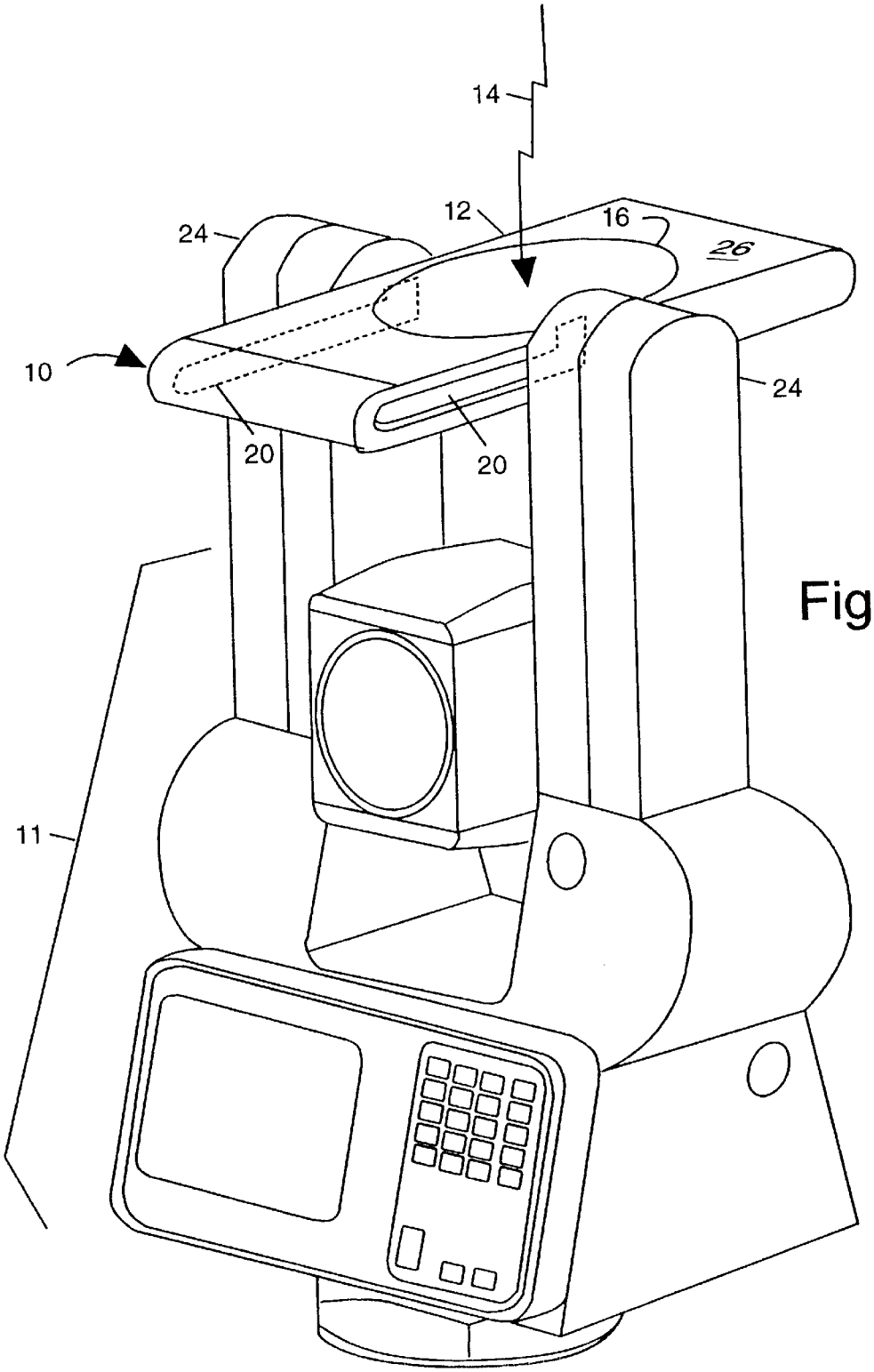
FIG. 1A is a perspective view of a navigation satellite system embodiment of the present invention mounted on a total station in a horizontal first position for receiving L-band microwave radio transmissions from orbiting navigation satellites.
Figure 1B:
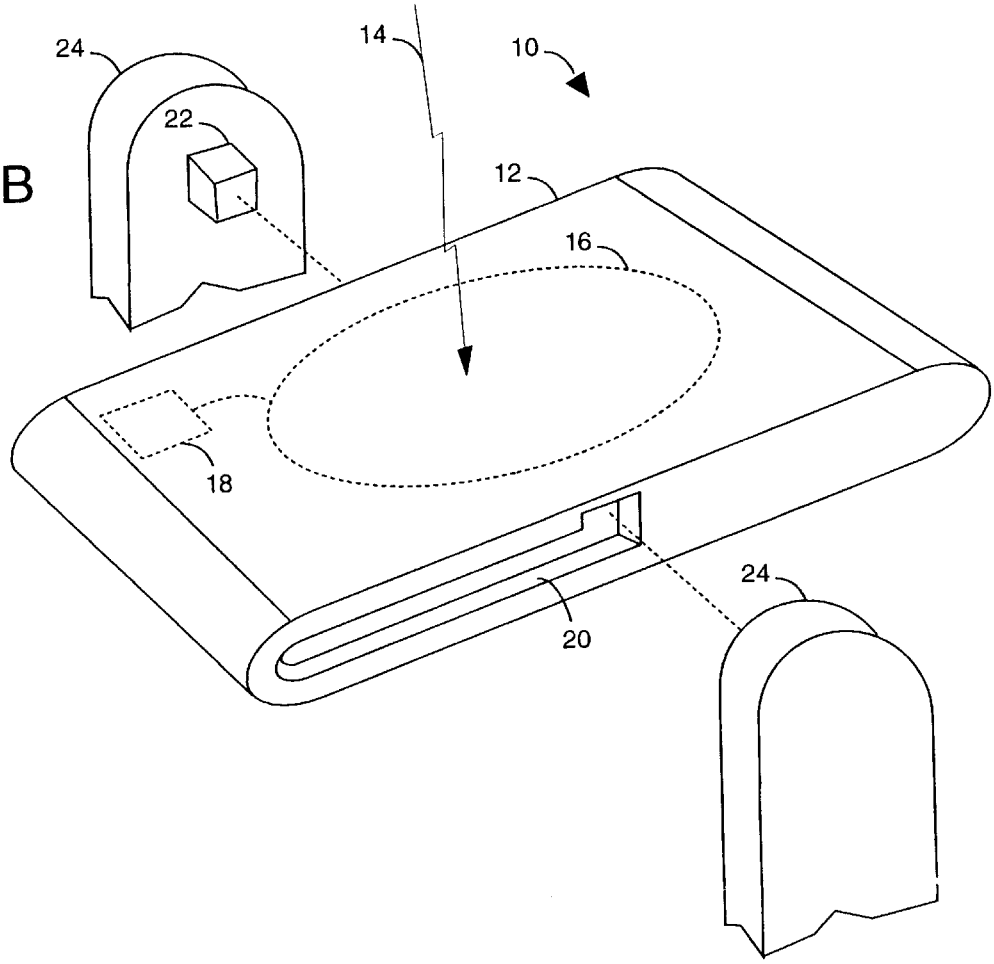
FIG. 1B is an exploded assembly view that focuses on the navigation satellite system component of FIG. 1A.

FIGS. 1A and 1B illustrate a navigation satellite system component embodiment of the present invention, referred to herein by the general reference numeral 10. The navigation satellite system component 10 is mounted to a surveyor's optical total station 11. A body 12 is relatively transparent to an L-band microwave radio transmission 14 from orbiting navigation satellites and may house either a complete receiver and antenna, or just an antenna. For example, a microwave patch antenna 16 can be embedded within the housing 12 connected to a low noise amplifier (LNA) 18. In the case where the whole receiver is included in the housing body 12, the diagram element 18 represents such receiver. For example, any of a number of conventional GPS receiver solutions completely implemented as chips or black boxes and available commercially can be used. Such placement helps increase the strength of the received signals before cable losses to an external receiver can bury the signals further in the noise. A pair of slots 20 on opposite side edges of the body 12 receive a pair of guide pins 22 on opposite inside surfaces of a pair of horns 24 that are at the top of an otherwise conventional optical total station. Such slots 20 and pins 22 can be used to connect power and/or signals between the antenna 16 and/or the receiver/LNA 18 to external equipment.

The body 12 can assume one of two preferred positions. Such horizontal first position is as shown in FIGS. 1A and 1B where a flat surface 26 of the body 12 is parallel to the ground and is presented skyward to allow the hemispherical reception of transmissions 14 from orbiting navigation satellites. Preferably, the electrical center of the patch antenna 16 is plumb to the vertical axis between pins 22. This allows a navigation receiver connected to the LNA 18 to assume the antenna 16 is plumb with the optical center of the total station 11. If not, such offset must be known and entered into the calculations that relate the satellite navigation position fix and the optical total station.

Figure 2A:
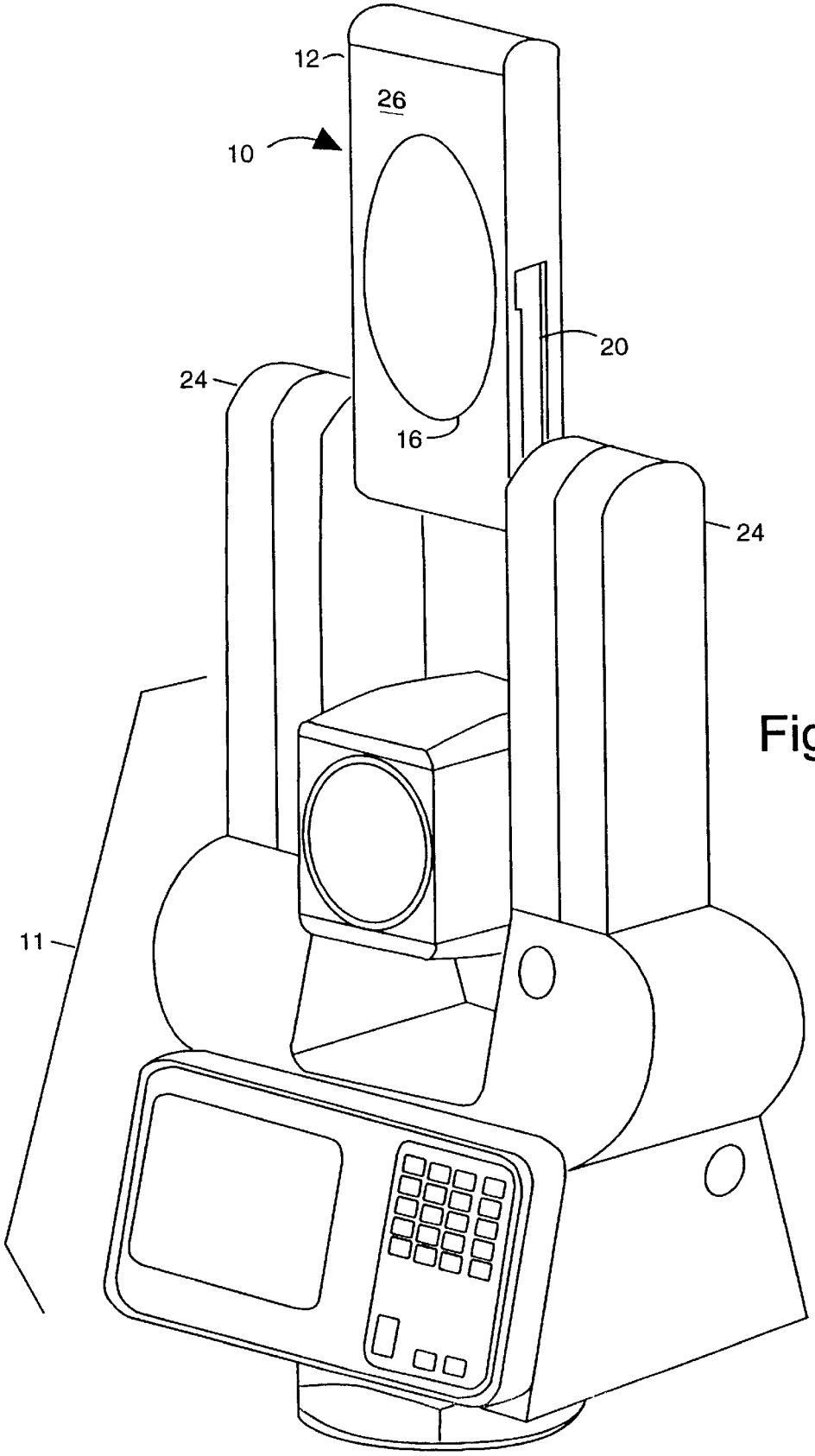
FIG. 2A is a perspective view of the navigation satellite system component of FIGS. 1A and 1B in a vertical second position for use as a carrying handle for the optical total station of FIG. 1A.
Figure 2B:
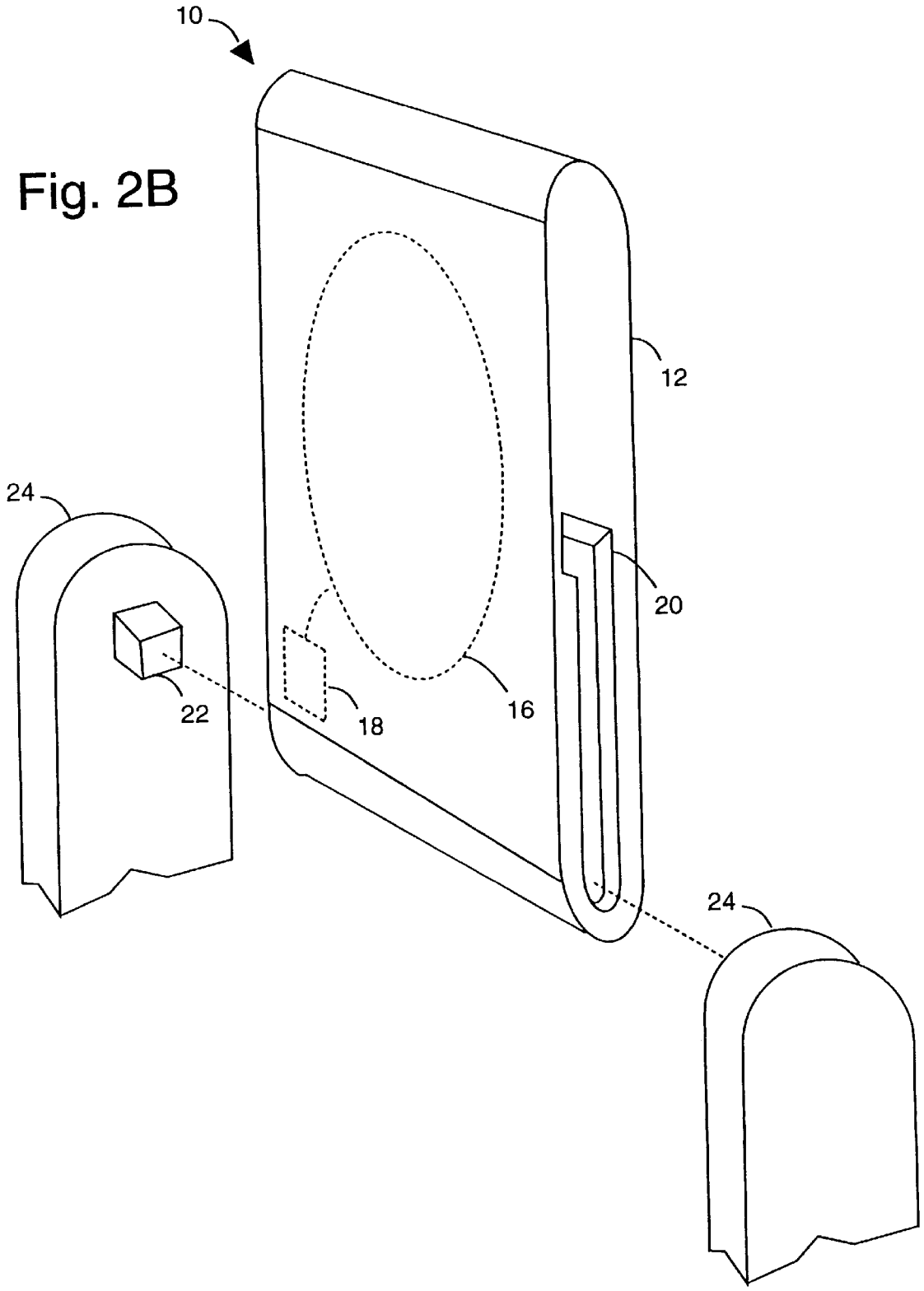
FIG. 2B is an exploded assembly view that focuses on the navigation satellite receiver antenna assembly of FIG. 2A.

FIGS. 2A and 2B represent the body 12 in its vertical second position. In such position, the body 12 can be used as a carrying handle to heft the optical total station by hand. The reception of transmissions 14 are unnecessary during off time and transport. The pins 22 are slid down slots 20 to the opposite extreme to allow the rotation of the body 12 and a gap sufficient for fingers.

Although the present invention has been described in terms of the presently preferred embodiment, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. A navigation satellite system component, comprising:

a housing to contain at least a microwave antenna for receiving L-band transmissions from orbiting navigation satellites through a first flat side and a low noise amplifier connected to said antenna for increasing the signal strength of said L-band transmissions; and a pair of slots on opposite sides of the housing and adjacent to said first flat side for receiving guide pins mounted to the inside surfaces of a pair of handle horns attached to the top of an optical total station;

wherein, said pair of slots and said guide pins permit a vertical and a horizontal positioning of the housing relative to said total station, and said horizontal positioning provides for the upward orientation of said first flat side toward the sky when said total station is in use and the reception of said transmissions from orbiting navigation satellites, and said vertical positioning provides for the use of the housing as a carrying handle for the optical total station.

2. The system component of claim 1, wherein:

the pair of slots and said pins electrically connect power and/or signals between said antenna and external equipment.

3. The system component of claim 1, further comprising:

a satellite navigation receiver disposed within the housing and connected to receive said L-band transmissions from said antenna.

4. The system component of claim 1, wherein:

the pair of slots and said pins connect power and/or signals between the receiver and external equipment.

5. A survey instrument, comprising:

an optical total station with a pair of handle horns on top that include a pair of guide pins mounted to the inside surfaces of said pair of handle horns;

a housing that contains at least a microwave antenna for receiving L-band transmissions from orbiting navigation satellites through a first flat side and a low noise amplifier connected to said antenna for increasing the signal strength of said L-band transmissions; and a pair of slots on opposite sides of the housing and adjacent to said first flat side for receiving said guide pins;

wherein, said pair of slots and said guide pins permit a vertical and a horizontal positioning of the housing relative to said total station, and said horizontal positioning provides for the upward orientation of said first flat side toward the sky when said total station is in use and the reception of said transmissions from orbiting navigation satellites, and said vertical positioning provides for the use of the housing as a carrying handle for the optical total station.

6. The survey instrument of claim 5, further comprising:

a satellite navigation receiver disposed within the housing and connected to receive said L-band transmissions from said antenna.

* * * * *